US005326180A

United States Patent [19]

Hirota

[11] Patent Number: 5,326,180

[45] Date of Patent: Jul. 5, 1994

[54] ARRANGING STRUCTURE OF PRINT WIRE DRIVING UNITS UTILIZED IN A DOT IMPACT PRINT HEAD

[75] Inventor: Atsushi Hirota, Nagoya, Japan

[73] Assignee: Brother Kogyo Kabushiki Kaisha, Nagoya, Japan

[21] Appl. No.: 946,178

[22] Filed: Sep. 16, 1992

[30] Foreign Application Priority Data

Sep. 18, 1991 [JP] Japan ..... 3-267119

[51] Int. Cl.[5] ..... B41J 2/295

[52] U.S. Cl. ..... 400/124; 101/93.05

[58] Field of Search ..... 400/124, 124 PZ; 101/93.05

[56] References Cited

U.S. PATENT DOCUMENTS

| | | | |
|---|---|---|---|
| 3,941,051 | 3/1976 | Barrus et al. | 101/93.04 |
| 4,589,786 | 5/1986 | Fukio et al. | 400/124 |
| 4,700,025 | 10/1987 | Bauer | 400/124 |
| 5,165,809 | 11/1992 | Takahashi et al. | 400/124 |

FOREIGN PATENT DOCUMENTS

| | | | |
|---|---|---|---|
| 0014765 | 1/1983 | Japan | 400/124 PZ |
| 0026273 | 2/1984 | Japan | 400/124 PZ |
| 0031975 | 2/1985 | Japan | 400/124 PZ |
| 0105548 | 6/1985 | Japan | 400/124 PZ |
| 0317354 | 12/1988 | Japan | 400/124 PZ |

*Primary Examiner*—Edgar S. Burr

*Assistant Examiner*—John S. Hilten

*Attorney, Agent, or Firm*—Kane, Dalsimer, Sullivan, Kurucz, Levy, Eisele and Richard

[57] ABSTRACT

An arranging structure of print wire driving units in print head utilized in a shuttle printer is disclosed. In such structure, a plurality of head units U each of which comprises the row R1 and the row R2 of the print wire driving units 10*a*, 10*b*, are arranged in the print head H1. The rows 10*a*, 10*b* are positioned at both sides (left and right sides) in the print head H1 with reference to a line passing through the wire guide plate 22. Here, the first driving unit 10*a* has a construction in which the arm 12*a* is supported by the plate springs S in a direction vertical to a longitudinal direction of the frame F in the unit 10*a* and the print wire 14*a* is fixed to the top portion of the arm 12*a* so that it is extended to the longitudinal direction of the frame F in the unit 10*a*. And the second print wire driving unit 10*b* has s construction in which the arm 12*b* is supported by the plate springs S in the same direction as the longitudinal direction of the frame F in the unit 10*b* and the print wire 14*b* is fixed to the top portion of the arm 12*b* so that it is extended to a direction vertical to the longitudinal direction of the frame F in the unit 10*b*. In both rows R1, R2, the first driving units 10*a* and the second driving units 10*b* are alternately arranged each other with right angle, thus, the arms 12*a*, 12*b* are arranged with parallel relationship therebetween and the print wires 14*a*, 14*b* are arrayed in a straight line on the wire guide plate 22.

11 Claims, 14 Drawing Sheets

ARRANGING STRUCTURE OF PRINT WIRE DRIVING UNITS UTILIZED IN A DOT IMPACT PRINT HEAD

BACKGROUND OF THE INVENTION

1. Field of the Invention

The present invention relates to an arranging structure of print wire driving units in a print head installed in a dot printer, particularly in a shuttle printer.

2. Description of the Related Art

A conventional shuttle printer is disclosed in U.S. Pat. No. 3,941,051. The shuttle printer includes a print head having a plurality of hammers which are arranged in a direction along a longitudinal direction of a platen. The plurality of hammers are individually moved between an impact position and a retract position by a plurality of electromagnetic actuators.

SUMMARY OF THE INVENTION

An inventor of the present invention developed a shuttle printer by using a print head having a plurality of print wire driving units each of which has a piezoelectric actuator. The piezoelectric actuator has advantages in comparison with the electromagnetic actuator. For example, the piezoelectric actuator can respond more quickly to a driving signal than the electromagnetic actuator. Further, the piezoelectric actuator generates less heat than the electromagnetic actuator. Consequently, the shuttle printer utilizing the piezoelectric actuator is capable of performing high speed printing with less heat generated.

Here, a structure of the print wire driving unit A will be described according to FIG. 15. This driving unit A essentially comprises a well-known piezoelectric driving unit in which a multi-layered piezoelectric member 110 is utilized. The piezoelectric member 110 is supported in a frame 112 and, to an upper end of the piezoelectric member 110, a movable member 114 is fixed. And a plate spring 116 is attached to a side surface of the movable member 114, further, one more plate spring 118 is fixed to the frame 112 in superposing with the plate spring 116.

And to upper ends of both the plate springs 116, 118, a retaining member 120 is attached. An arm 122 to a top end portion of which a base portion of a print wire 124 is fixed, is horizontally extended as shown in FIG. 15. A top end portion of the print wire 124 is opposed to a print sheet 128 as a printing medium supported on a platen 126, through a print ribbon 130 arranged between the print sheet 128 and the top end portion of the print wire 124.

Accordingly, when the piezoelectric member 110 is extended by energizing through power source, the plate spring 116 is slidden relatively to the plate spring 118 to a positive direction, thereby, the retaining member 120 is rotated to counterclockwise direction in FIG. 15. As a result, the print wire 124 is advanced to the print sheet 128 since the arm 122 is rotated to counterclockwise direction with the retaining member 120 and a printing dot is formed on the print sheet 128 by depressing the the print ribbon 130 on the print sheet 128 through the top end portion of the print wire 124.

On the contrary, when the piezoelectric member 110 is contracted from the extended state by removing electric energy therefrom, the retaining member 120 is rotated to clockwise direction, as a result, the print wire 124 is returned to retracted position. And when the print wire 124 returns to the retracted position, it is contacted with a rubber stopper 132 which is adhered to the frame 112 at behind side of the arm 122 and limits the retracted position of the print wire 124.

Here, a temperature compensating member 134 is fixed to lower end of the piezoelectric member 110. This temperature compensating member 134 depresses the piezoelectric member upward to the movable member 114 through a pin 136 accommodated in the frame 112. The temperature compensating member 134 is necessary to avoid a case that the piezoelectric member 110 cannot be extended to the proper printing position due to a residual stress remained in the piezoelectric member 110 since the residual stress corresponding to the temperature of the piezoelectric member 110 is apt to be remained therein if the electric energy (voltage) is completely removed therefrom.

In order to arrange a plurality of the print wires in the print head of the shuttle printer, the above constructed driving units A are arranged parallel therein. For instance, each of the driving units A is mutually arranged in side by side relationship.

However, in such parallel arranging structure, it is necessary to arrange the driving units A with sufficient distance between the driving units A so that the print wires 124 does not contact with the neighboring driving units A while driving of the print wires 124. In order to dissolve this problem, it is necessary to widen the distance between the neighboring print wires 124 in excess of the thickness of the driving unit A, therefore, accumulating or densifying of the print wires 124 in the print head cannot be accomplished.

Especially in the shuttle printer, moving distance of the print head between the neighboring print wires 124 becomes unnecessarily long distance, thus, it is prevented printing speed of the print head from being made more faster, since the long distance must be formed between the print wires 124 in the parallel arranging structure.

Accordingly, it is an object of the present invention to overcome the above mentioned problems and to provide an arranging structure of print wire driving units utilized in a dot impact print head to accomplish accumulating or densifying of the print wires, thereby to make printing speed by the print head more faster, the arranging structure comprising:

a plurality of first print wire driving units each having a first unit frame; a first driving means mounted in said first unit frame; a first arm supported to said first driving means at a first predetermined angle, said first arm being thinner than said first unit frame; and a first print wire having a rear portion affixed to said first arm and extending at an angle of approximately 90° thereto, and a front portion adapted to extend through said print head front surface to effect printing;

a plurality of second print wire driving units each having a second unit frame, the thickness of said second unit frame being equal to that of said first unit frame; a second driving means mounted in said second unit frame; a second arm supported to said second driving means at a second predetermined angle, said second arm being thinner than said second unit frame; and a second print wire having a rear portion affixed to said second arm and extending at an angle of approximately 90° thereto, and a front portion adapted to extend through said print head front surface to effect printing;

said plurality of first print wire driving units being disposed side by side and said plurality of second print wire driving units being disposed side by side, said first and second pluralities being at an angle with respect to each other so that said first arms and said second arms are parallel and said first unit frames being offset with respect to said second unit frames by half the thickness of said second unit frames whereby said first and second print wires alternately extend in a straight line through said print head front surface.

According to the present invention, accumulating or densifying of the first and the second print wires can be accomplished since the first and the second driving units are alternately arranged with the difference angle between the first and the second predetermined angles so that the first and the second arms are arranged each other with the parallel relationship therebetween and with the narrower distance than the predetermined thickness therebetween. Therefore, if the arranging structure is utilized in the print head of the shuttle printer, printing speed can be made more faster because moving distance of the print head while printing can be reduced.

BRIEF DESCRIPTION OF THE DRAWINGS

The present invention will be described with reference to the following drawings, wherein.

DETAILED DESCRIPTION OF THE PREFERRED EMBODIMENTS

A detailed description of the first preferred embodiment of an arranging structure of print wire driving units in a dot impact print head embodying the present invention will be given referring to the accompanying drawings.

Figure 1:
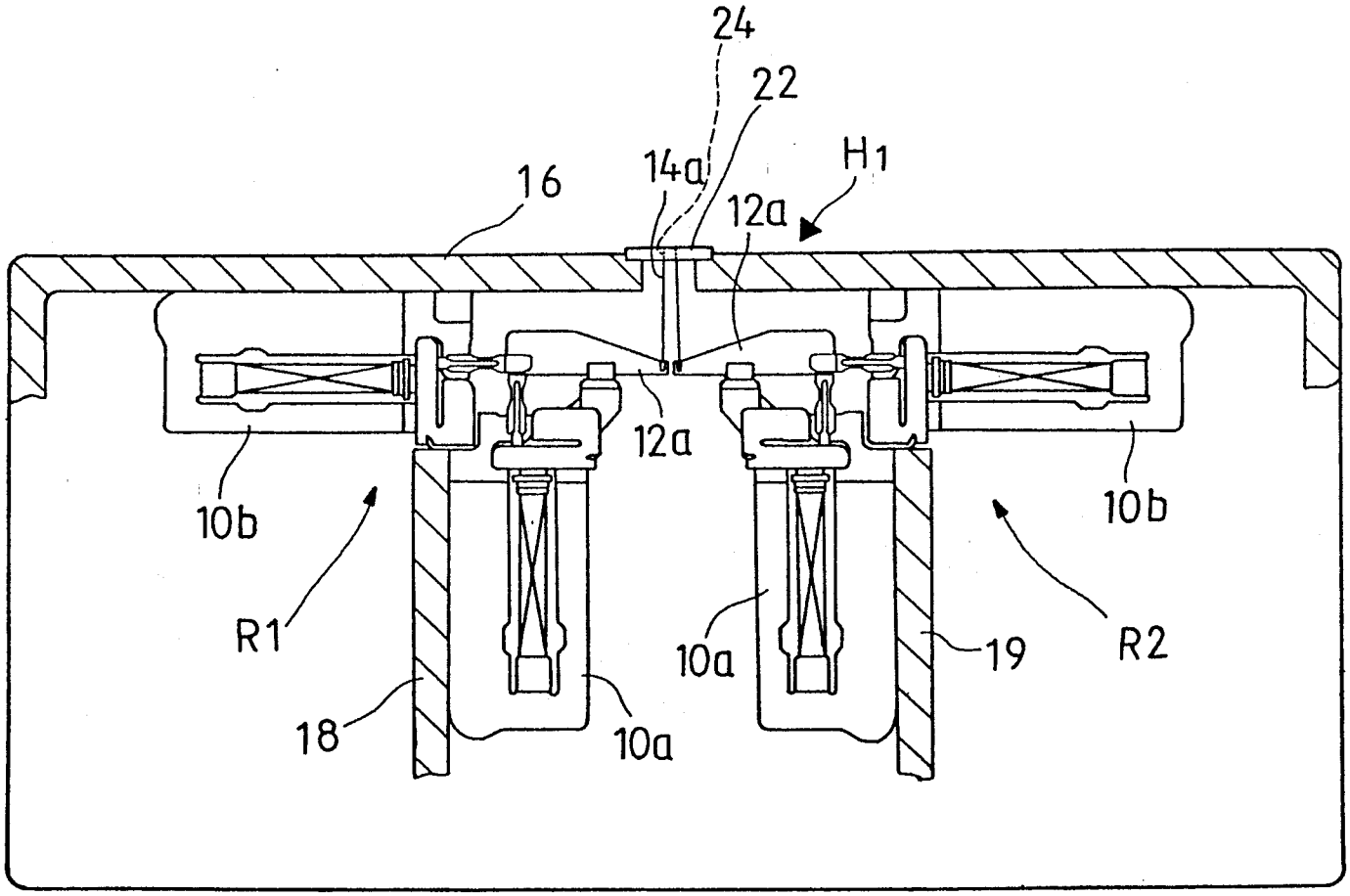
FIG. 1 is a schematic sectional view of print head unit in which two rows of the print wire driving units are arranged, according to the first embodiment of the present invention.
Figure 2:
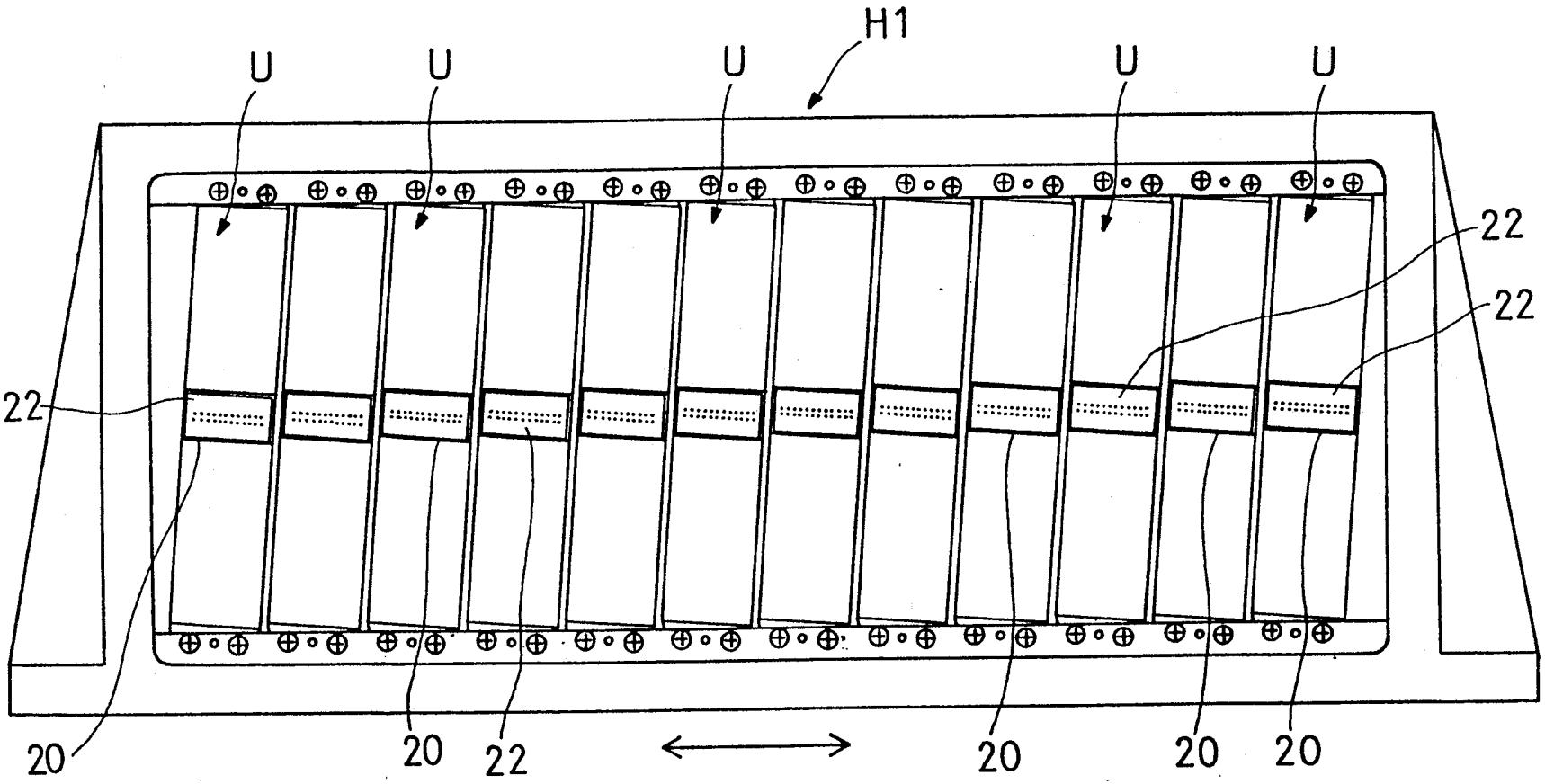
FIG. 2 is a front view of the print head, in which a plurality of the print head units are arranged with side by side relationship.

In FIGS. 1 through 6, the first embodiment of the present invention is shown. Referring to FIGS. 1 and 2, a print head H1 utilized in a shuttle printer has a front frame 16 and two mounting frames 18, 19 positioned in the print head H1 with right angle to the front frame 16, both the frames 18, 19 being parallel formed along a longitudinal direction of the print head H1 (see FIG. 2). And, in the front frame 16, a plurality of rectangle openings 20 for passing print wires 14*a*, 14*b* (later mentioned) therethrough are formed according to a horizontal line lying in the middle of the print head H1, as shown in FIG. 2. At front side of each opening 20, a wire guide plate 22 having twenty four guide holes 24 is fixed.

Over both a left inner side of the front frame 16 and a right side of the mounting frame 18, a row R1 comprising a plurality of the first print wire driving units 10*a* and the second print wire driving units 10*b* is arranged (arranging structure thereof will be described later). Similarly, another row R2 having the same structure as the row R1 is arranged over a right inner side of the front frame 16 and a left side of the mounting frame 19. Here, the rows R1, R2 constitute a head unit U and a plurality of the head units U (twelve units U are arranged in this first embodiment) are arranged in the print head HI as shown in FIG. 2.

Next, the arranging structure of the rows R1, R2 will be described according to FIGS. 3 through 6.

Figure 3:
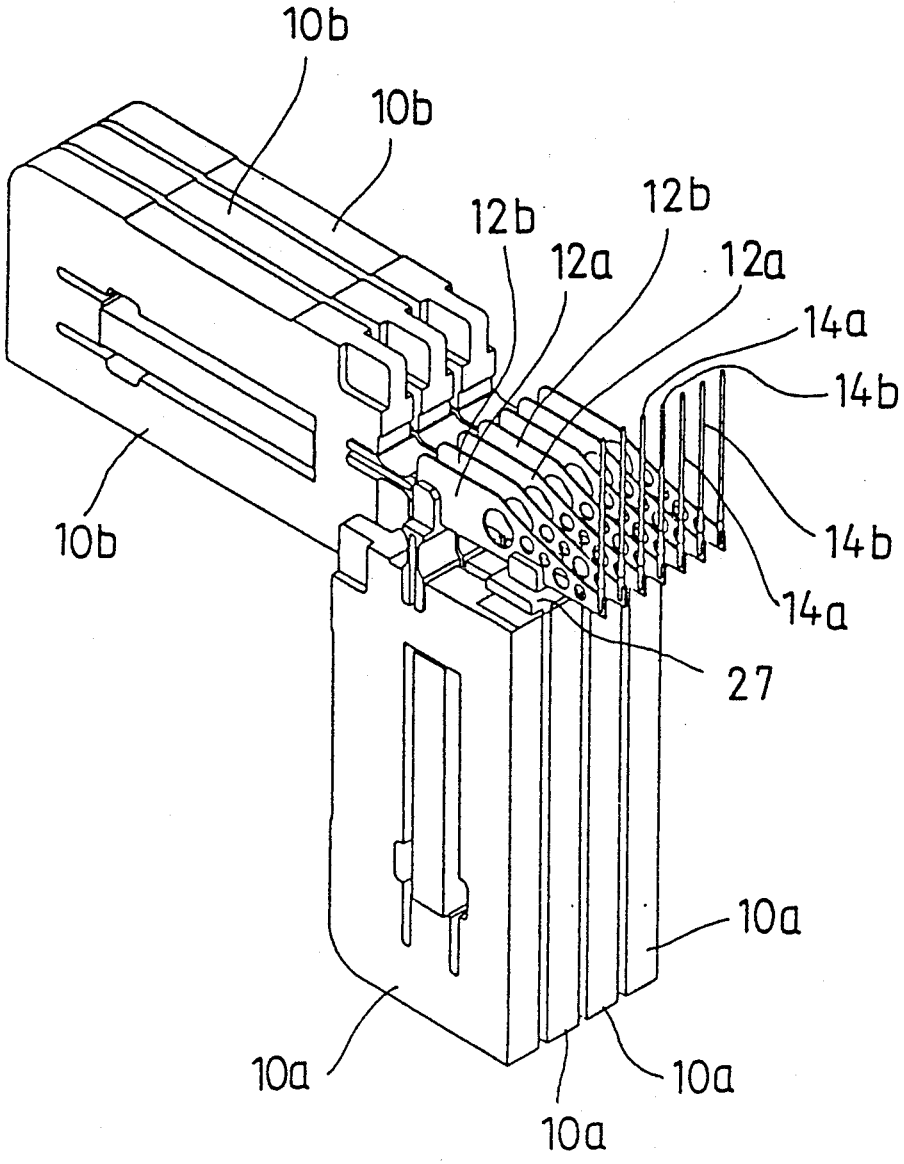
FIG. 3 is a perspective view showing the arranging structure of the row shown in FIG. 1, in which both the first and the second print wire driving units are arranged alternately with right angle.
Figure 4:
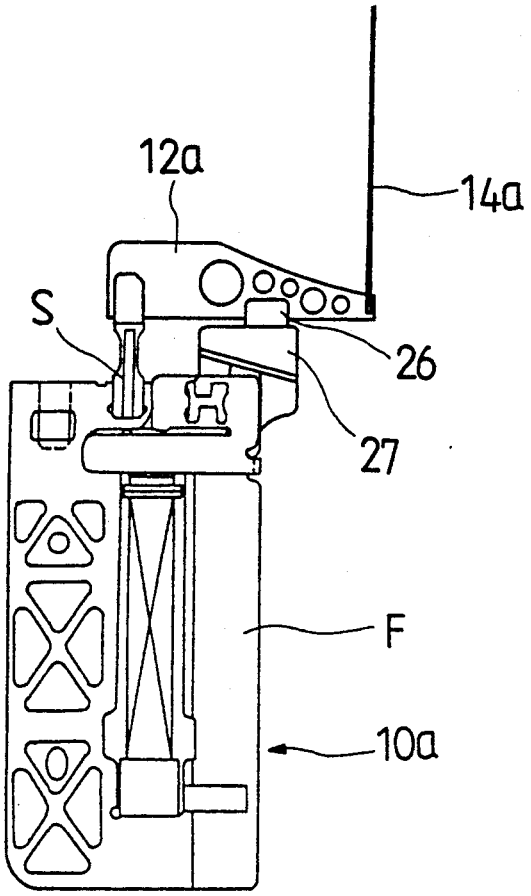
FIG. 4 is a side view of the first print wire driving unit.
Figure 15:
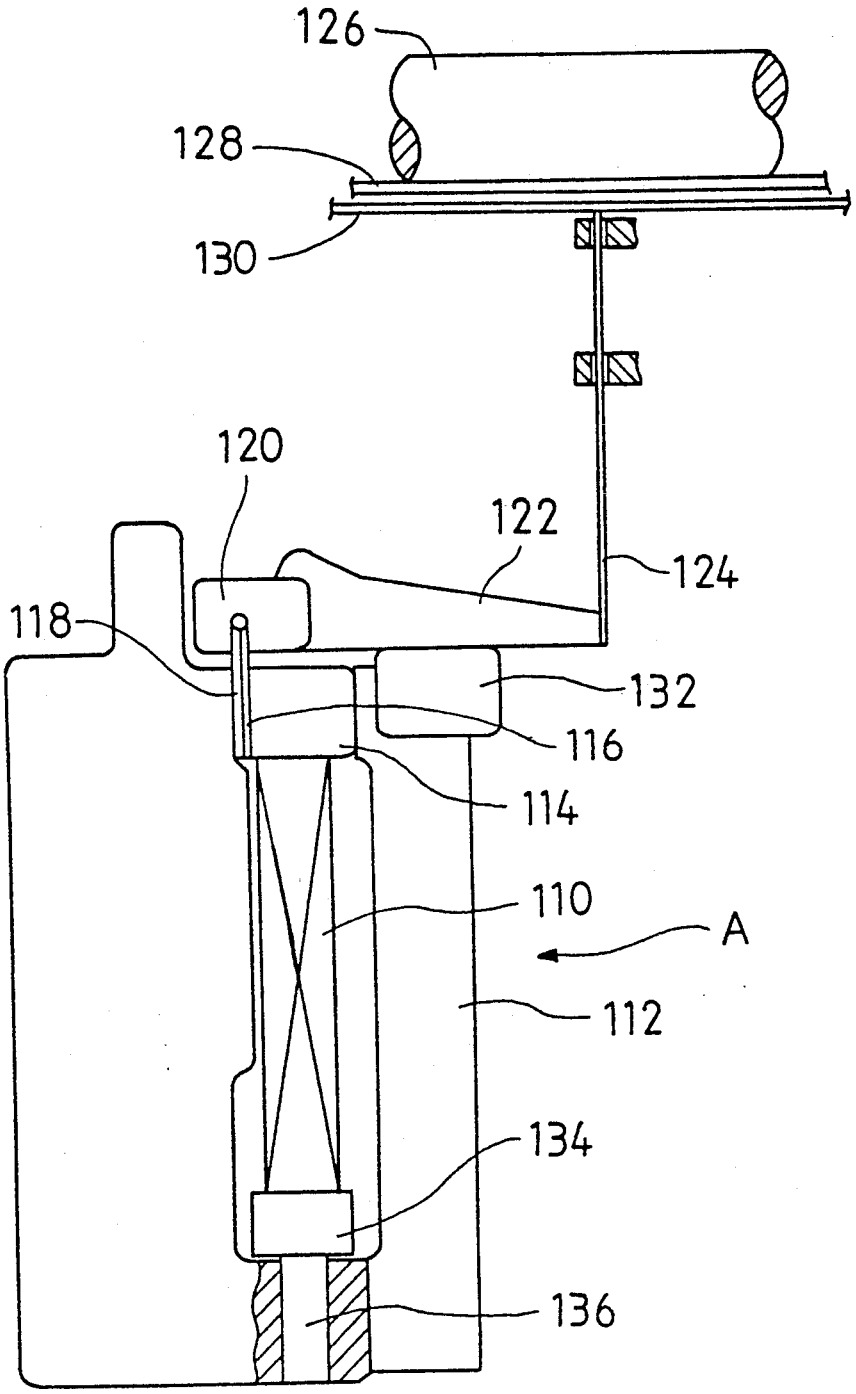
FIG. 15 is a schematic side view of the print wire driving unit utilized in the parallel arranging structure.

At first, the first print wire driving unit 10*a* is explained referring to FIG. 4. The first print wire driving unit 10*a* has an essentially same structure of the driving unit shown in FIG. 15, thus, detailed description thereof is omitted here. That is to say, it should be noted that an arm 12*a* is supported to plate springs S in a direction vertical to a longitudinal direction of frame F of the driving unit 10*a* (that is, the arm 12*a* is supported to the plate springs S with 90 degrees) and a print wire 14*a* is fixed to the top portion of the arm 12*a* so that the print wire 14*a* is extended parallel to the longitudinal direction of the frame F of the driving unit 10*a*. Further, in the print wire driving unit 10*a*, a buffer member 26 is attached to behind side of the arm 12*a* against to a stopper 27 elongated over upper surfaces of the driving units 10*a* (see FIG. 3).

Figure 5:
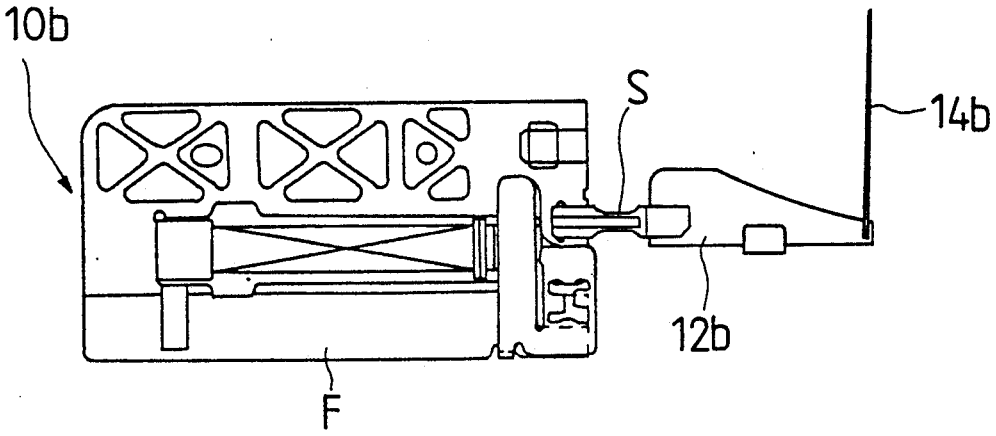
FIG. 5 is a side view of the second print wire driving unit.

The second print wire driving unit 10*b* is shown in FIG. 5. This type of the driving unit is different from the first driving unit 10*a* at a point that an arm 12*b* is supported to plate springs S in the same direction as the longitudinal direction of the frame F of the driving unit 10*b* (that is, the arm 12*b* is supported to the plate springs S with 0 degree) and a print wire 14*b* is fixed to the top portion of the arm 12*b* so that the print wire 14*b* is extended vertically to the longitudinal direction of the frame F of the driving unit 10*b*.

The first print wire driving units 10*a* and the second print wire driving units 10*b* are mutually arranged as shown in FIG. 3. In FIG. 3, the first driving units 10*a* are vertically arranged each other with substantial side by side relationship. Here, though, in fact, twelve units 10*a* are arranged, only four units 10*a* are shown in FIG. 3 for convenience. And the second driving units 10*b* are horizontally arranged each other with substantial side by side relationship so that each second driving unit 10*b* is deviated in a thickness direction of the frame F in the first driving unit 10*a* with a half distance of the thickness of the frame F and the arms 12*b* are position between the arms 12*a* of the first units 10*a*. Similarly to the above, though, in fact, twelve units 10*b* are arranged, only three units 10*b* are shown in FIG. 3 for convenience. Here, the arms 12*a*, 12*b* does not interfere each other since thickness of the arms 12*a*, 12*b* is sufficiently thinner than the thickness of the frame F in the driving units 10*a*, 10*b*. And the thickness of the frame F in the first driving unit 10*a* is as same as that of the frame F in the second driving unit 10*b*.

Therefore, both the first and the second driving units 10*a*, 10*b* are alternately arranged each other with right angle. And each first driving unit 10*a* is fixed to the right side of the mounting frame 18 and each second driving unit 10*b* is fixed to the left inner side of the front frame 16 as shown in FIG. 1. As a result, the row R1 is arranged over the mounting frame 18 and the front frame 16.

Figure 6:
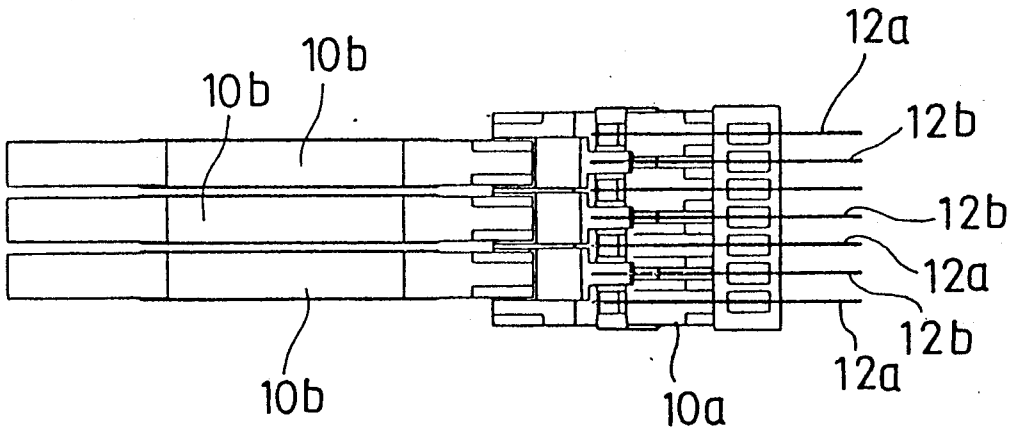
FIG. 6 is a plain view showing the arranging structure of the row of the print wire driving units shown in FIG. 1.

In the row R1, accordingly, the arm 12*a* in the driving unit 10*a* and the arm 12*b* in the driving unit 10*b* are parallel arranged each other as shown in FIGS. 3 and 6, as a result, the print wire 14*a* of the arm 12*a* and the print wire 14*b* of the arm 12*b* are mutually directed to the same direction on a straight line so that the top portions of the print wires 14*a*, 14*b* are put into the guide holes 24 of the guide plate 22. Therefore, a wire array constructed by the top portions of the print wires 14*a*, 14*b* is formed on the front surface of the guide plate 22 as shown in FIG. 2.

Similarly to the row R1, another row R2 having the same structure as the row R1 is arranged symmetrically on the opposite (right) side of the row R1 in taking a vertical line passing through the center of the opening 20 as the symmetrical standard line in FIG. 1. That is to say, in the row R2, the second driving unit 10*b* is fixed to the right inner side of the front frame 16 and the first driving unit 10*a* is fixed to the left side of the mounting frame 19. And the print wires 14*a*, 14*b* of the arms 12*a*, 12*b* are mutually directed to the same direction on a straight line so that the top portions of the print wires 14*a*, 14*b* are put into the guide holes 24 of the guide plate 22. Accordingly, another wire array constructed by the top portions of the print wires 14*a*, 14*b* in the row R2 is formed on the front surface of the guide plate 22 as shown in FIG. 2. As a result, two wire arrays are parallel formed on the front surface of the guide plate 22.

Clearly from the above arranging structure according to the first embodiment, it can be prevented both the driving units 10*a* and 10*b* from interfering the print wires 14*a* and 14*b* adjoining each other, though accumulating or densifying of the print wires cannot be realized in the parallel arranging structure of the driving units due to relatively wide width in the piezoelectric member or the plate spring. Accordingly, the distance between the print wires 14*a*, 14*b* adjoining each other can be reduced to a half of the distance in comparison with the parallel arranging structure in which each driving unit is simply arranged with side by side relationship, as understood from FIG. 3. Therefore, forty-eight print wires 14*a*, 14*b* can be arranged in the head unit U with same size as the parallel head unit in which only twenty-four print wires are arranged, as a result, printing density becomes twice comparing with the parallel head unit.

Figure 16:
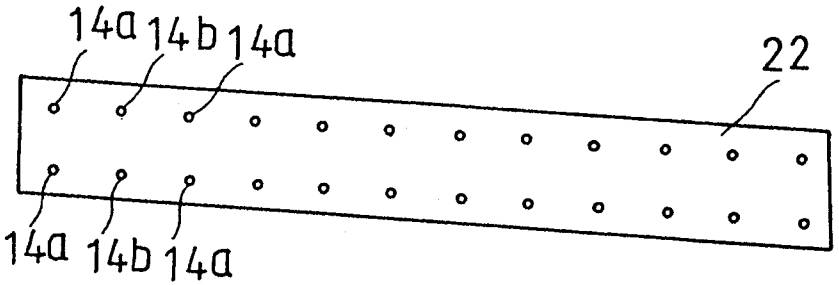
FIG. 16 is a front view of wire guide plate, on the front surface of which two arrays of the print wires, in each array the print wires being arranged with high density, are formed and, FIG. 17 is a front view of wire guide plate in the parallel arranging structure, on the front surface of which two arrays of the print wires, in each array the print wires are arranged with low density, are formed.
Figure 17:
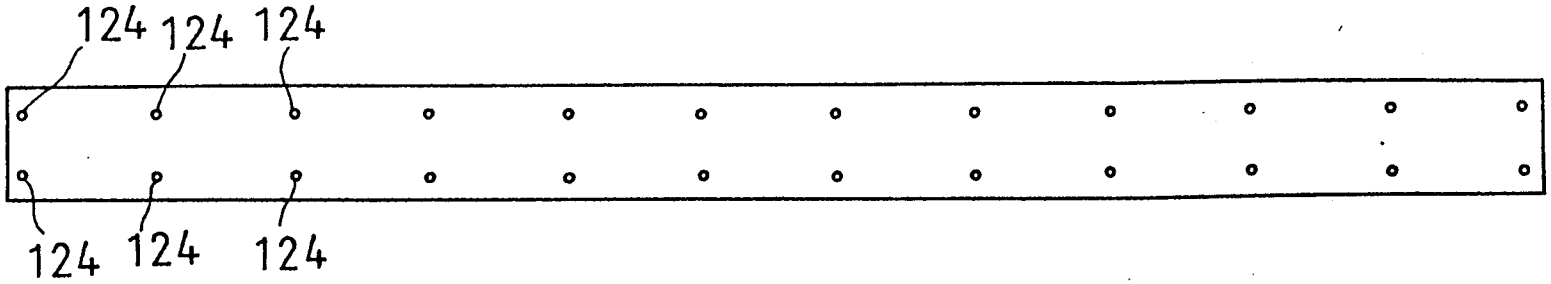

On the other hand, for instance, on case that the number of the print wires arranged in the print head H1 is same, the print wires 14*a*, 14*b* can be arranged with high density (twice density) in the wire guide plate 22 as shown in FIG. 16, according to the first embodiment mentioned above, in comparison with the parallel arranging structure in which the print wires 124 are arranged with low density (half density of the arranging structure shown in FIG. 16) in the print head.

Further, according to the above arranging structure, the print wires 14*a*, 14*b* can be shortened as shown in FIG. 1, thus, the print wires 14*a*, 14*b* can be easily guided by only the wire guide plate 22. Here, the print head H1 is reciprocally moved according to an arrow direction shown in FIG. 2 and printing is conducted.

Figure 7:
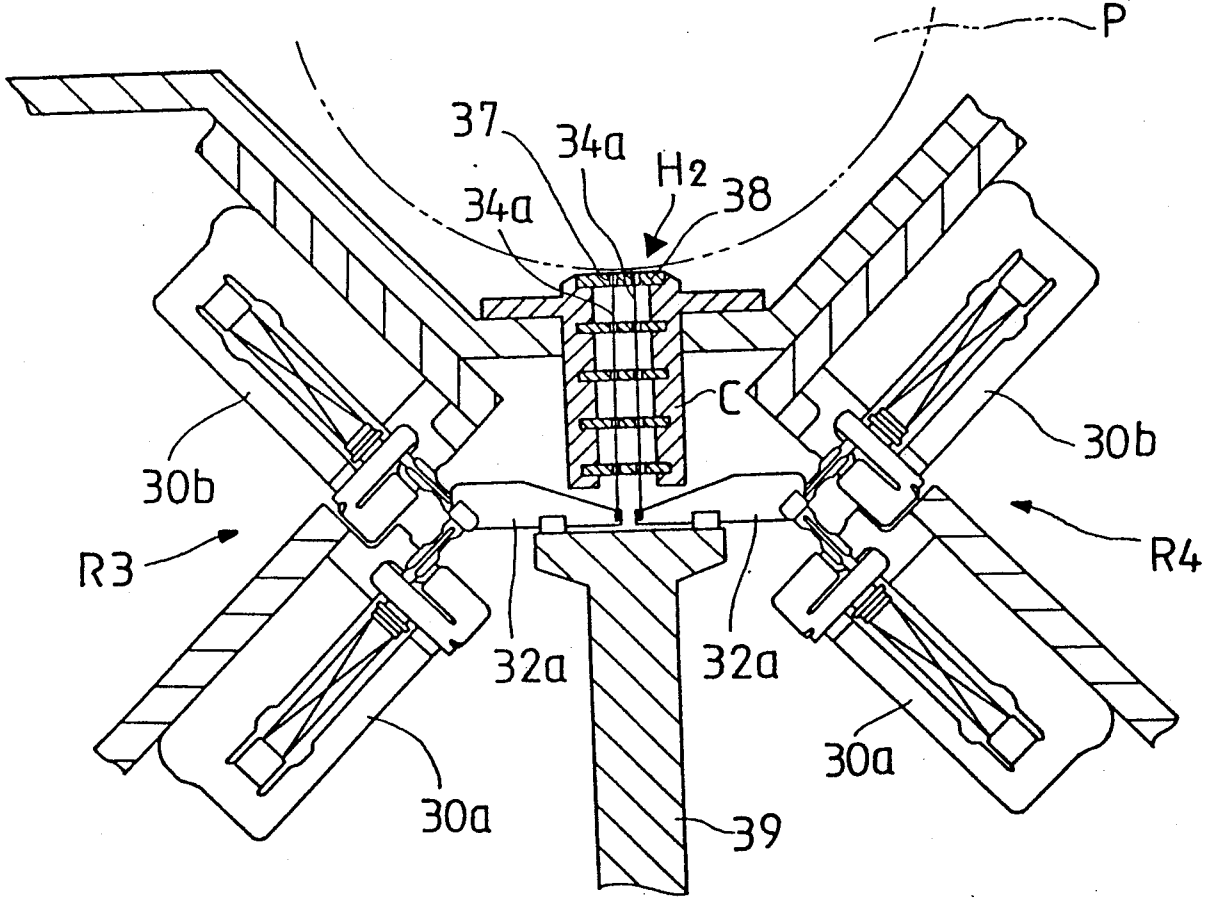
FIG. 7 is a schematic sectional view of the second print head unit in which two rows, each comprising both the third and the fourth print wire driving units, are arranged, according to the second embodiment of the present invention.
Figure 8:
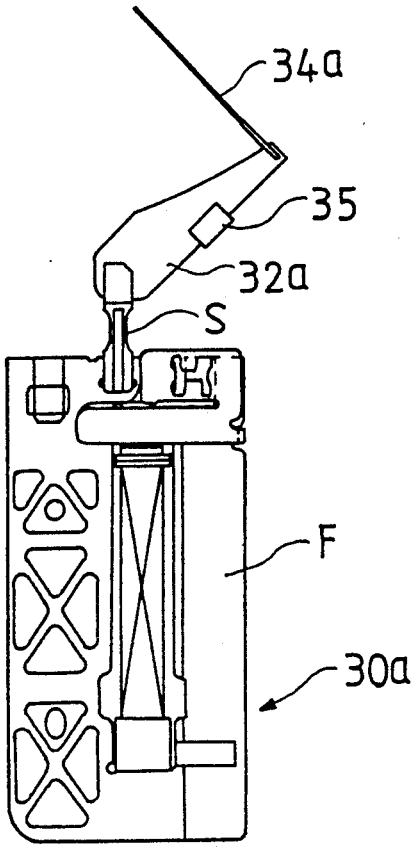
FIG. 8 is a side view of the third print wire driving unit.
Figure 9:
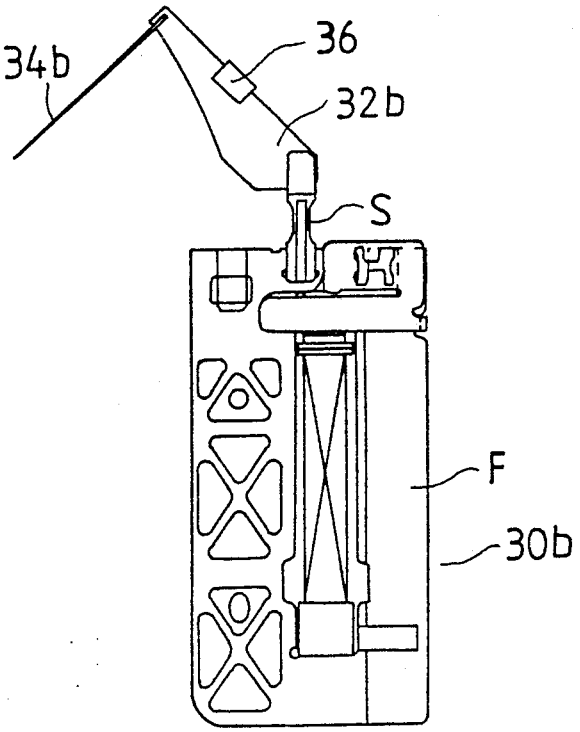
FIG. 9 is a side view of the fourth print wire driving unit.

Next, the second embodiment of the present invention will be described hereinafter referring to FIGS. 7 through 9. In FIG. 7, a print head H2 comprises two rows R3, R4, each having third and fourth print wire driving units 30*a*, 30*b*.

Here, the third driving unit 30*a* and the fourth driving unit 30*b* will now be described according to FIGS. 8 and 9. In FIG. 8, the third driving unit 30*a* has an essentially same structure of the first and the second driving units 10*a*, 10*b*. Different point from the first and the second driving units 10*a*, 10*b* is that fixing angle of an arm 32*a* to plate springs S is set to 45 degrees around the clockwise direction (see FIG. 8) with reference to a line extending through longitudinal direction of frame F in the third driving unit 30*a*. And a buffer member 35 is attached to behind side of the arm 32*a*.

On the other hand, the fourth driving unit 30*b* has an essentially same structure of the third driving unit 30*a* and different point from the third driving unit 30*a* is that fixing angle of an arm 32*b* to plate springs S is set to 45 degrees around the counterclockwise direction (see FIG. 9) with reference to a line extending through longitudinal direction of frame F in the fourth driving unit 30*b*. And a buffer member 36 is attached to behind side of the arm 32*b*.

Again referring to FIG. 7, explanation of the print head H2 will be continued hereinafter. In the row R3, the third driving unit 30*a* and the fourth driving unit 30*b* are arranged each other with right angle in the print head H2 so that both the arms 32*a* and 32*b* are alternately positioned with parallel relationship therebetween. That is to say, the fourth driving units 30*b* are alternately arranged to downward direction with 45 degrees with reference to a horizontal line and the third driving units 30a are alternately arranged between the fourth driving units 30b to upward direction with 45 degrees with reference to the horizontal line, as shown in FIG. 7. As a result, print wires 34a, 34b, each being fixed to the top portions of the arms 32a, 32b, respectively, are mutually directed to the same direction on a straight line so that the top portions of the print wires 34a, 34b are put into guide holes 37 of wire guide plate 38.

Similarly to the row R3, another row R4 having the same structure as the row R3 is arranged symmetrically on the opposite (right) side of the row R3 in taking a vertical line passing through the center of the guide plate 38 as the symmetrical standard line.

Thus, two wire arrays constructed by the top portions of the print wires 34a, 34b are formed on the front surface of the guide plate 38.

Here, in FIG. 7, a stopper member 39 is positioned behind both the buffer members 35, 36 and a plurality of support guide plates for guiding the print wires 34a, 34b and the wire guide plate 38 are positioned in a head case C.

According to the above arranging structure of the second embodiment, the print wires 34a, 34b can be arranged with twice density in comparison with the parallel print head, similarly to the first embodiment mentioned above. And further, space surrounding the print head H2 can be efficiently utilized because it is not prevented the fourth driving units 30b from being arranged to downward direction with 45 degrees if a round platen (roller platen) P is utilized as shown in FIG. 7.

Figure 10:
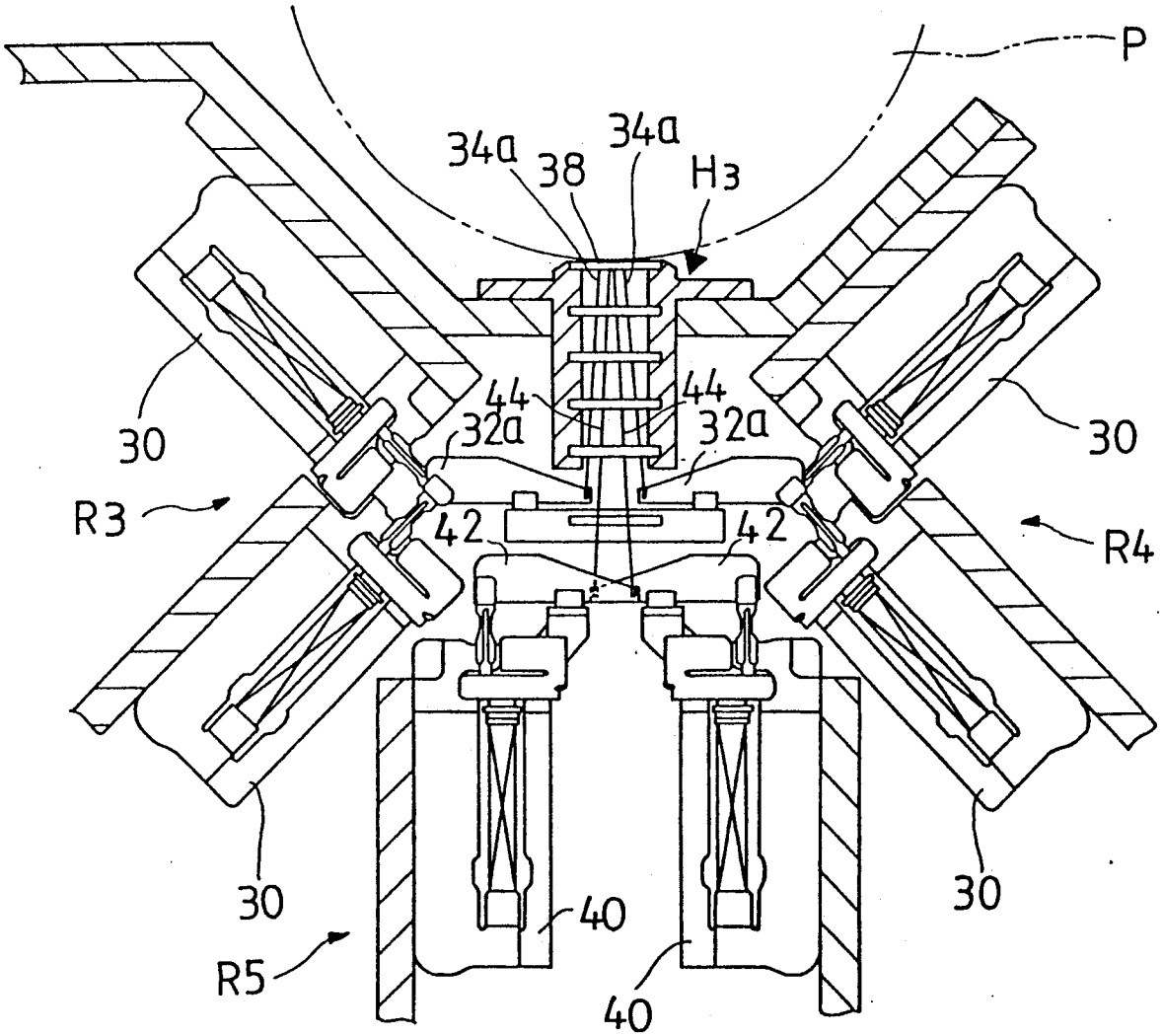
FIG. 10 is a schematic sectional view of the third print head unit in which three rows comprising one row of the first print wire driving units and two rows of both the third and the fourth print wire driving units shown in FIG. 7, are arranged, according to the third embodiment of the present invention.
Figure 11:
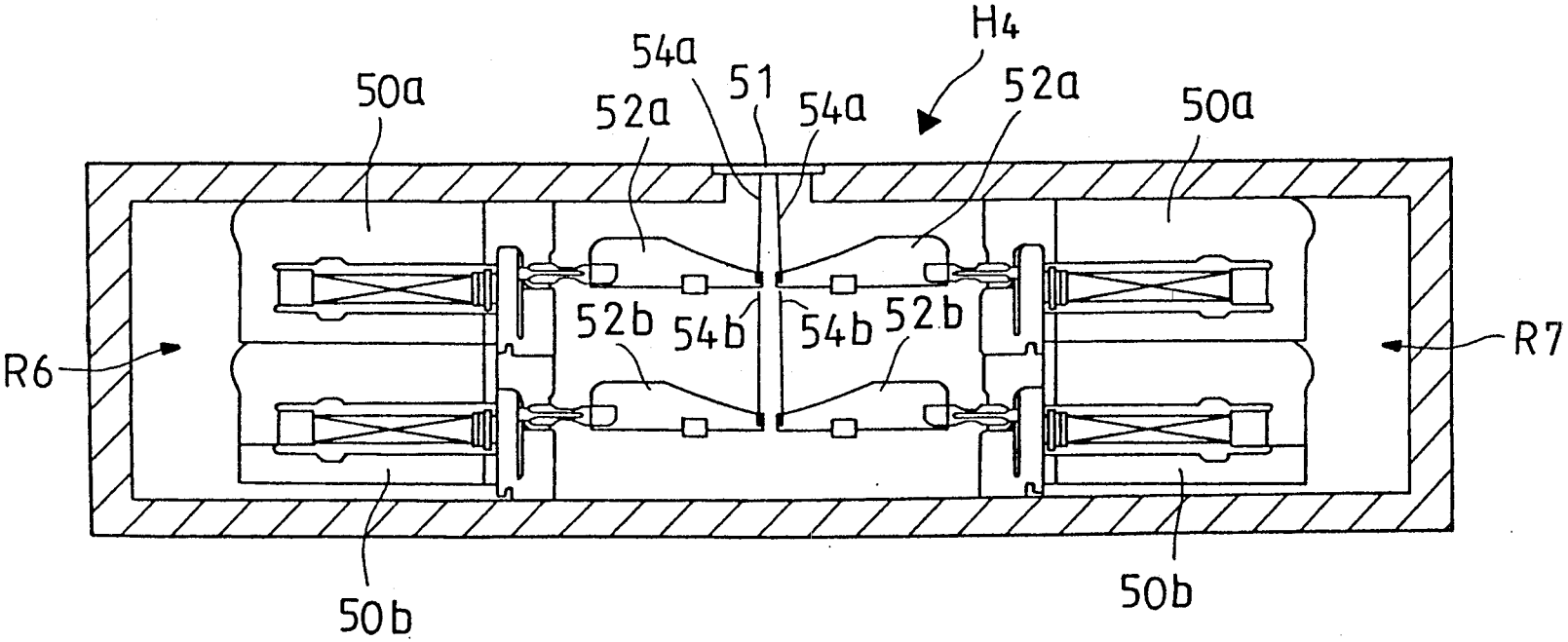
FIG. 11 is a schematic sectional view of the print head unit in which two rows, each comprising the second print wire driving units shown in FIG. 5 arranged mutually with up and down relationship, are arranged, according to the fourth embodiment of the present invention.

Next, the third embodiment of the present invention will be described hereinafter referring to FIG. 10. In FIG. 10, a print head H3 comprises a construction in which a new row R5 (later mentioned) is added to the print head H2 having the row R3 and the row R4 mentioned above. The row R5 in which a plurality of print wire driving units 40 (each is same as the first driving unit 10a) are arranged so that top portion of each arm 42 is alternately arranged with opposing relationship, is arranged to a position where the stopper member 39 is positioned in the print head H2. According to the arranging structure of the third embodiment, three arrays of the print wires 34a, 34b and 44 are formed on the front surface of wire guide plate 38. Clearly understood from FIG. 10, since each driving unit 30a, 30b and 40 does not interfere each other, distance between two print wires in each array can be reduced to half in comparison with the parallel arranging structure in which each driving unit is simply arranged with side by side relationship.

Finally, the fourth embodiment of the present invention will be described hereinafter referring to FIGS. 11 through 14. In a print head H4, two rows R6 and R7 are arranged at both sides with reference to a symmetrical line passing a wire guide plate 51 mounted at the center of the front surface of the print head H4.

Figure 12:
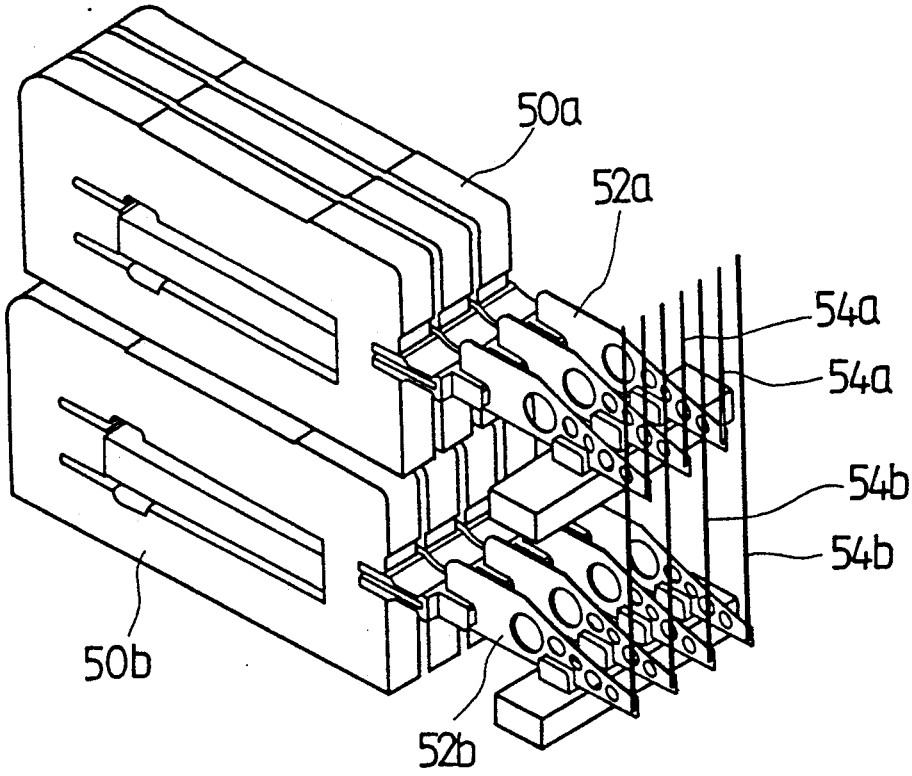
FIG. 12 is a perspective view showing the arranging structure of the row of the print wire driving units shown in FIG. 11.
Figure 13:
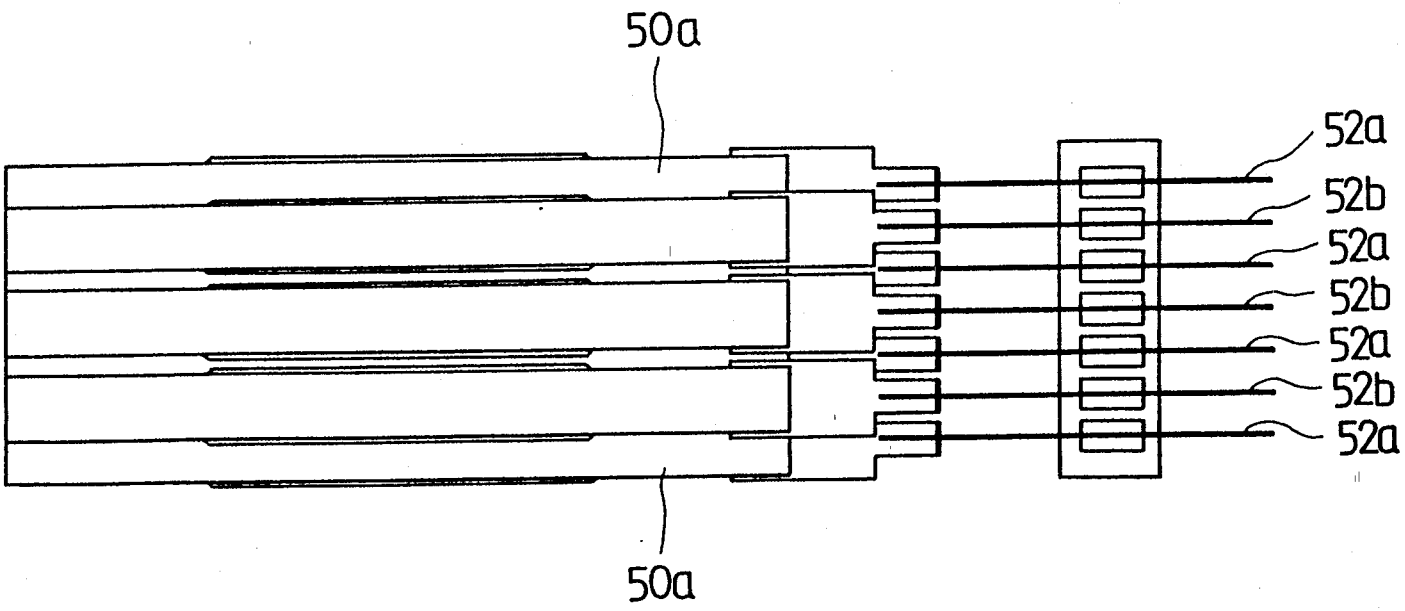
FIG. 13 is a plain view showing the arranging structure of the row of the print wire driving units shown in FIG. 11.
Figure 14:
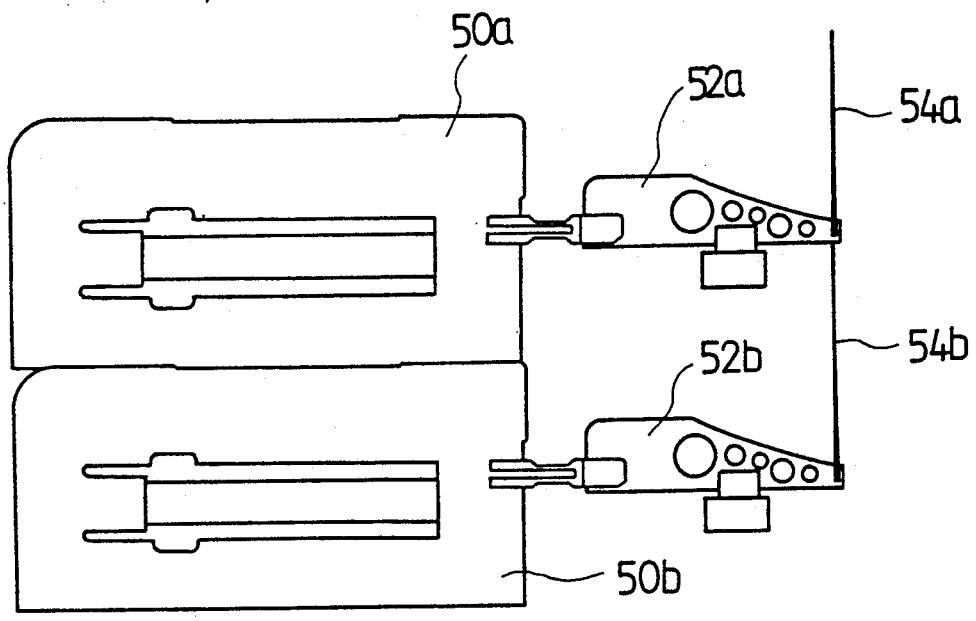
FIG. 14 is a side view showing the arranging structure of the row of the print wire driving units shown in FIG. 11.

Here, each of the row R6 and the row R7 has the same construction, thus, the row R6 will be representatively described according to FIGS. 12 through 14. In the row R6, a plurality of print wire driving units 50b, each having the same construction as the second driving unit 10b utilized in the first embodiment mentioned above, are arranged each other with side by side relationship.

And further, a plurality of print wire driving units 50a, each also having the same construction as the second driving unit 10b, are arranged on the driving units 50b in superposing each other with up and down relationship therebetween, so that each driving unit 50a is slightly deviated from each of the driving unit 50b with a half distance of the thickness of the driving unit 50b as shown in FIGS. 12 and 14.

As a result, each upper arm 52a of the driving unit 50a is positioned between lower arms 52b of the driving units 50b while the upper arms 52a are separated from the lower arms 52b with a predetermined distance therebetween. Further, based on the above relationship between the arms 52a and 52b, print wires 54a of the driving units 50a are arranged between print wires 54b of the driving units 50b so that top portions of the print wires 54a, 54b are arrayed in a straight line on the wire guide plate 51. Here, the print wires 54b are made longer than the print wires 54a so as to retain the same level as the print wires 54a.

Additionally, the row R7 has the same construction as the row R6 mentioned above, therefore, two arrays of the print wires 54a, 54b are formed on the wire guide plate 51.

According to the fourth embodiment mentioned above, distance between the print wire 54a and 54b in the array can be reduced to half in comparison with the parallel arranging structure in which each driving unit is simply arranged with side by side relationship. Therefore, printing density becomes twice comparing with the parallel head unit.

Further, in comparison with the first embodiment in which the driving units 10a, 10b having different construction from each other are utilized, both the driving units 50a, 50b can be driven based on the same driving condition since they have the same construction each other.

While the invention has been particularly shown and described with reference to preferred embodiments thereof, it will be understood by those skilled in the art that the foregoing and other changed in form and details can be made therein without departing from the spirit and scope of the invention. For instance, it is conceivable a modification in which an additional driving unit to the driving units 50a, 50b in the fourth embodiment is arranged in three steps with up and down relationship so that the additional driving unit is deviated from both the driving units 50a, 50b by ⅓ distance of the thickness thereof. In such modification, printing density becomes three times in comparison with the parallel arranging structure.

And further, it is conceivable a modification in which top portions of the print wires are arranged into one array on the wire guide plate, though two arrays formed by the top portions of the print wires are arranged on the wire guide plate in the above embodiments.

What is claimed is:

1. An arranging structure of print wire driving units utilized in a dot impact print head, said print head having a front surface through which dot printing is effected, said arranging structure comprising:

a plurality of first print wire driving units each having a first unit frame; a first driving means mounted in said first unit frame; a first arm supported to said first driving means at a first predetermined angle of 90° between a longitudinal axis of said first arm and a longitudinal axis of said first driving means, said first arm being thinner than said first unit frame; and a first print wire having a rear portion affixed to said first arm and extending at an angle of approximately 90° thereto, and a front portion adapted to extend through said print head front surface to effect printing;

a plurality of second print wire driving units each having a second unit frame, the thickness of said second unit frame being equal to that of said first frame unit frame; a second driving means mounted in said second unit frame; a second arm supported to said second driving means at a second predetermined angle of 0° between a longitudinal axis of said second arm and a longitudinal axis of said second driving means, said second arm being thinner than said second unit frame; and a second print wire having a rear portion affixed to said second arm and extending at an angle of approximately 90° thereto, and a front portion adapted to extend through said print head front surface to effect printing;

said plurality of first print wire driving units being disposed side by side and said plurality of second print wire driving units being disposed side by side, said first and second pluralities being at an angle with respect to each other so that said first arms and said second arms are parallel and said first unit frames being offset with respect to said second unit frames by half the thickness of said second unit frames, whereby said first and second print wires alternately extend in a straight line through said print head front surface.

2. The arranging structure in accordance with claim 1 wherein said first and second pluralities of print wire driving units are offset from each other by 90°.

3. The arranging structure of the print wire driving Units according to claim 1 wherein each of the first and the second driving means has a piezoelectric transducer and a mechanism for transmitting displacement of the piezoelectric transducer to the first and second arm, respectively.

4. The arranging structure of the print wire driving units according to claim 1 further comprising:

a front head frame having an opening in a middle position thereof, an inner face of said front head frame, a first plurality of first print wire driving units and a first plurality of second print wire driving units on said inner face on one side of said opening; and a second plurality of first print wire driving units and a second plurality of second print wire driving units on said inner face on an opposite side of said opening.

5. An arranging structure of print wire driving units utilized in a dot impact print head, said print head having a front surface through which dot printing is effected, said arranging structure comprising:

a plurality of first print wire driving units each having a first unit frame; a first driving means mounted in said first unit frame; a first arm supported to said first driving means at a first predetermined angle of approximately 45° between a longitudinal axis of said first arm and a longitudinal axis of said first driving means, said first arm being thinner than said first unit frame; and a first print wire having a rear portion affixed to said first arm and extending at an angle of approximately 90° thereto, and a front portion adapted to extend through said print head front surface to effect printing;

a plurality of second print wire driving units each having a second unit frame, the thickness of said second unit frame being equal to that of said first frame unit frame; a second driving means mounted in said second unit frame; a second arm supported to said second driving means at a second predetermined angle of approximately 45° between a longitudinal axis of said second arm and a longitudinal axis of said second driving means opposite to said first predetermined angle, said second arm being thinner than said second unit frame; and a second print wire having a rear portion affixed to said second arm and extending at an angle of approximately 90° thereto, and a front portion adapted to extend through said print head front surface to effect printing;

said plurality of first print wire driving units being disposed side by side and said plurality of second print wire driving units being disposed side by side, said first and second pluralities being at an angle with respect to each other so that said first arms and said second arms are parallel and said first unit frames being offset with respect to said second unit frames by half the thickness of said second unit frames, whereby said first and second print wires alternately extend in a straight line through said print head front surface.

6. The arranging structure of the print wire driving units according to claim 5 further comprising:

a front head frame having an opening in a middle position thereof, an inner face of said front head frame, a first plurality of first print wire driving units and a first plurality of second print wire driving units on said inner face on one side of said opening; and a second plurality of first print wire driving units and a second plurality of second print wire driving units on said inner face on an opposite side of said opening.

7. The arranging structure of print wire driving units according to claim 6 further comprising:

a plurality of third print wire driving units each having a third unit frame; a third driving means mounted in said third unit frame; a third arm supported to said third driving means at a third predetermined angle, said third arm being thinner than said third unit frame; and a third print wire having a rear portion affixed to said third arm and extending at an angle of approximately 90° thereto, and a front portion adapted to extend through said print head front surface to effect printing;

said third print wire driving units being alternately arranged so that the third arm in one unit extends parallel to and in a direction opposite to that of a third arm in an adjacent unit, and said third print wire front portions extend along said straight line.

8. A print head for a shuttle printer having a head frame, a front surface of said head frame, an arranging structure of print wire driving units in the head frame, said arranging structure comprising:

a plurality of first print wire driving units each having a first unit frame; a first driving means mounted in said first unit frame; a first arm supported to said first driving means at a first predetermined angle of 90° between a longitudinal axis of said first arm and a longitudinal axis of said first driving means, said first arm being thinner than said first unit frame; and a first print wire having a rear portion affixed to said first arm and extending at an angle of approximately 90° thereto, and a front portion adapted to extend through said print head front surface to effect printing;

a plurality of second print wire driving units each having a second unit frame the thickness of said second unit frame being equal to that of said first frame unit frame; a second driving means mounted in said second unit frame; a second arm supported to said second driving means at a second predetermined angle of 0° between a longitudinal axis of said second arm and a longitudinal axis of said second driving means, said second arm being thinner than said second unit frame; and a second print wire having a rear portion affixed to said second arm and extending at an angle of approximately 90° thereto, and a front portion adapted to extend through said print head front surface to effect printing;

said plurality of first print wire driving units being disposed side by side and said plurality of second print wire driving units being disposed side by side, said first and second pluralities being at an angle with respect to each other so that said first arms and said second arms are parallel and said first unit frames being offset with respect to said second unit frames by half the thickness of said second unit frames, whereby said first and second print wires alternately extend in a straight line through said print head front surface.

9. An arranging structure of print wire driving units utilized in a dot impact print head, said print head having a front surface through which dot printing is effected, said arranging structure comprising:

a plurality of first print wire driving units each having a first unit frame; a first driving means mounted in said first unit frame; a first arm supported to said first driving means at a first predetermined angle of 0° between a longitudinal axis of said first arm and a longitudinal axis of said first driving means, said first arm being thinner than said first unit frame; and a first print wire having a rear portion affixed to said first arm and extending at an angle of approximately 90° thereto, and a front portion adapted to extend through said print head front surface to effect printing;

a plurality of second print wire driving units each having a second unit frame, the thickness of said second unit frame being equal to that of said first unit frame; a second driving means mounted in said second unit frame; a second arm supported to said second driving means at a second predetermined angle of 0° between a longitudinal axis of said second arm and a longitudinal axis of said second driving means, said second arm being thinner than said second unit frame; and a second print wire having a rear portion affixed to said second arm and extending at an angle of approximately 90° thereto, and a front portion adapted to extend through said print head front surface to effect printing;

said plurality of first print wire driving units being disposed side by side and said plurality of second print wire driving units being disposed side by side, said first plurality being disposed over said second plurality so that said first arms and said second arms are parallel and said first unit frames being offset with respect to said second unit frames by half the thickness of said second unit frames, whereby said first and second print wires alternately extend in a straight line through said print head front surface.

10. The arranging structure of the print wire driving units according to claim 9 wherein each of the first and second driving means has a piezoelectric transducer and a mechanism for transmitting displacement of the piezoelectric transducer to the first and second arms, respectively.

11. A print head for a shuttle printer having a head frame, a front surface of said head frame, an arranging structure of print wire driving units in the head frame, said arranging structure comprising:

a plurality of first print wire driving units each having a first unit frame; a first driving means mounted in said first unit frame; a first arm supported to said first driving means at a first predetermined angle of 0° between a longitudinal axis of said first arm and a longitudinal axis of said first driving means, said first arm being thinner than said first unit frame; and a first print wire having a rear portion affixed to said first arm and extending at an angle of approximately 90° thereto, and a front portion adapted to extend through said print head front surface to effect printing;

a plurality of second print wire driving units each having a second unit frame, the thickness of said second unit frame being equal to that of said first unit frame; a second driving means mounted in said second unit frame; a second arm supported to said second driving means at a second predetermined angle of 0° between a longitudinal axis of said second arm and a longitudinal axis of said second driving means, said second arm being thinner than said second unit frame; and a second print wire having a rear portion affixed to said second arm and extending at an angle of approximately 90° thereto, and a front portion adapted to extend through said print head front surface to effect printing;

said plurality of first print wire driving units being disposed side by side and said plurality of second print wire driving units being disposed side by side, said first plurality being disposed over said second plurality so that said first arms and said second arms are parallel and said first unit frames being offset with respect to said second unit frames by half the thickness of said second unit frames, whereby said first and second print wires alternately extend in a straight line through said print head front surface.

* * * * *